US008714725B2

(12) United States Patent
Thayer et al.

(10) Patent No.: US 8,714,725 B2
(45) Date of Patent: May 6, 2014

(54) IMAGE RECEIVING MEMBER WITH INTERNAL SUPPORT FOR INKJET PRINTER

(75) Inventors: Bruce Earl Thayer, Spencerport, NY (US); Bin Zhang, Penfield, NY (US); Trevor James Snyder, Newberg, OR (US); Joseph Benjamin Gault, West Linn, OR (US); Palghat Ramesh, Pittsford, NY (US); Paul J. McConville, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 180 days.

(21) Appl. No.: 13/293,710

(22) Filed: Nov. 10, 2011

(65) Prior Publication Data

US 2013/0120513 A1 May 16, 2013

(51) Int. Cl.
*B41J 2/01* (2006.01)

(52) U.S. Cl.
USPC ..... 347/102; 347/101; 347/104

(58) Field of Classification Search
USPC ..... 347/88, 89, 102, 101, 104; 101/216
See application file for complete search history.

(56) References Cited

U.S. PATENT DOCUMENTS

| | | | | |
|---|---|---|---|---|
| 4,117,705 | A * | 10/1978 | Dempsey | 72/237 |
| 4,348,579 | A | 9/1982 | Namba | |
| 4,830,509 | A * | 5/1989 | Gulmatico, Jr. | 366/153.1 |
| 5,007,342 | A | 4/1991 | Abendroth et al. | |
| 5,341,159 | A | 8/1994 | Kerr | |
| 5,708,949 | A | 1/1998 | Kasahara et al. | |
| 5,713,221 | A | 2/1998 | Myers et al. | |
| 6,639,622 | B2 | 10/2003 | Kerr | |
| 7,784,177 | B2 | 8/2010 | Back et al. | |
| 2002/0112633 | A1 * | 8/2002 | Fukui | 101/477 |
| 2004/0155038 | A1 * | 8/2004 | Smith | 220/9.2 |
| 2004/0234306 | A1 | 11/2004 | Gheer et al. | |
| 2006/0191139 | A1 * | 8/2006 | Hayashi et al. | 29/895.32 |
| 2008/0207034 | A1 * | 8/2008 | Aita | 439/277 |
| 2008/0298831 | A1 * | 12/2008 | VanKouwenberg et al. | 399/92 |
| 2009/0092927 | A1 | 4/2009 | Choi et al. | |
| 2009/0219328 | A1 | 9/2009 | Godil et al. | |
| 2009/0291377 | A1 * | 11/2009 | Hirose et al. | 430/97 |
| 2010/0247186 | A1 | 9/2010 | Tanaka et al. | |
| 2010/0296848 | A1 | 11/2010 | Yamamoto et al. | |

FOREIGN PATENT DOCUMENTS

| | | | |
|---|---|---|---|
| EP | 1 759 848 | A2 | 3/2007 |
| GB | 1 486 998 | | 9/1977 |
| JP | 2005-221712 | A | 8/2005 |
| JP | 2005-338623 | A | 12/2005 |
| JP | 2005-352297 | A | 12/2005 |
| JP | 2008-20821 | A | 1/2008 |

OTHER PUBLICATIONS

Search Report of the Intellectual Property Office corresponding to GB Application No. GB1219963.4; Intellectual Property Office, Concept House, Cardiff Road, Newport, South Wales, NP10 8QQ; Feb. 27, 2013 (4 Pages).

* cited by examiner

*Primary Examiner* — Manish S Shah
*Assistant Examiner* — Yaovi Ameh
(74) *Attorney, Agent, or Firm* — Maginot, Moore & Beck, LLP

(57) ABSTRACT

A thin wall ink image receiving member enables the ink image receiving member to reach operational temperatures from a cold state more quickly than image receiving members used in previously known printers. The thin wall image receiving member includes at least one annular support member fixedly mounted against the inner surface of the cylindrical wall to enable the image receiving member to provide adequate pressure in a nip formed with a transfix roller to transfer an ink image from the image receiving member to media in the nip.

11 Claims, 8 Drawing Sheets

IMAGE RECEIVING MEMBER WITH INTERNAL SUPPORT FOR INKJET PRINTER

TECHNICAL FIELD

This application is directed to imaging devices having heated image receiving members, and, more particularly, to rotating image receiving members that are heated to a predetermined temperature prior to receiving ink images.

BACKGROUND

Drop on demand inkjet printing systems eject ink drops from print head nozzles in response to pressure pulses generated within the print head by inkjet ejectors that are implemented with either piezoelectric devices or thermal transducers, such as resistors. The printheads have a plurality of inkjet ejectors that are fluidly connected at one end to an ink supplying manifold through an ink channel and at another end to a nozzle in an aperture plate. The ink drops are ejected through the nozzles, which are sometimes called apertures.

In a typical piezoelectric inkjet printing system, application of an electrical signal to a piezoelectric transducer causes the transducer to expand. This expansion pushes a diaphragm, which is positioned adjacent the transducer, into a pressure chamber filled with ink received from the manifold. The diaphragm movement urges ink out of the pressure chamber and through the aperture to eject liquid ink drops. The ejected drops, referred to as pixels, land on an image receiving member opposite the printhead to form an ink image. The respective channels from which the ink drops were ejected are refilled by capillary action through the ink channel from an ink manifold.

In some phase change or solid ink printers, known as indirect printers, the image receiving member is a rotating drum or belt coated with a release agent and the ink is a phase change material that is normally solid at room temperature. In these solid ink printers, the ink image is transferred from the rotating image receiving member to a recording medium, such as paper. The transfer is generally conducted in a nip formed by the rotating image receiving member and a rotating pressure roller, which is also called a transfix roller. One or both of the transfix roller and the recording medium may be heated prior to the recording medium entry in the transfixing nip. As a sheet of paper is transported through the nip, the fully formed image is transferred from the image receiving member and fixed on the sheet of paper. This technique of using heat and pressure at a nip to transfer and fix an image to a recording medium passing through the nip is typically known as "transfixing," a well-known term in the art, particularly with solid ink technology.

During printing operations, phase change inks in solid form are melted to form liquid ink for ejection by the inkjet ejectors. The phase change inks melt when heated above a predetermined melting temperature that is determined by the chemical formulation of the solid ink. One or more heaters in the printer heat the surface of the image receiving member so that ink drops on the imaging drum remain in a liquid state prior to being transfixed onto the media sheet. A typical embodiment of a heater is an electric heater that heats the surface of the image receiving member in response to an electrical current being passed through the heater. The image receiving member is configured as a rotating drum that is heated to an average temperature of approximately 60° C. prior to receiving ink drops that form latent ink images for printing.

At various times, the image receiving members in indirect solid ink printers may cool to a temperature that is below the operating temperature that enables the image receiving member to facilitate transfer of ink images from the receiving member to a media sheet. For example, if the printer is turned off, the heater is deactivated and the temperature of the image receiving member drops to the ambient temperature of the environment surrounding the printer. Modern printers also include power saving modes that deactivate heaters and other components when the printer is not in use to reduce the consumption of electrical power.

When a printer with a "cold" image receiving member receives a print job, a controller activates the heater to enable the temperature of the image receiving member to rise to a predetermined operating temperature before the ink ejectors eject drops onto the image receiving member to form ink images. The amount of time taken to heat the image receiving member to the operating temperature results in a delay from the time that the printer receives a print job to the time that the printer produces the first printed page. In one common scenario, a printer with a "cold" image receiving member receives a print job that includes a small number of printed pages (e.g. one or two pages). The amount of time required to heat the image receiving member to the operating temperature represents a substantial portion of the total time taken to execute print jobs with a small number of pages. Consequently, improvements to the operation of indirect inkjet printers that reduce the amount of time that is needed to commence printing when the printer has a "cold" image receiving member would be beneficial.

SUMMARY

In one embodiment, an image receiving member for a phase-change inkjet printer has been developed that enables the member to reach an operational temperature more quickly. The image receiving member includes a cylindrical wall having a first and a second end having a length between the first end and the second end and a thickness that form an outer surface configured to receive and carry phase change ink images and an inner surface defining an internal volume of the image receiving member, a first annular support member positioned in the internal volume of the image receiving member that is fixedly engaged to at least a portion of the inner surface of the cylindrical wall, and a heater positioned in the internal volume of the cylindrical wall at a location that enables the heater to direct heat generated by the heater toward the inner surface of the cylindrical wall. The first annular support member has a length that is less than the length of the cylindrical wall.

In another embodiment, an ink image receiving and transfer roller have been developed that enables a printer to commence printing operations from a "cold" state more quickly. The ink image receiving member and transfer roller include an ink receiving member having a cylindrical wall having an outer surface configured to receive and carry phase change ink images and an inner surface defining an internal volume of the image receiving member, a plurality of annular support members positioned in the internal volume of the cylindrical wall and fixedly engaged to the inner surface of the cylindrical wall, a heater positioned in the internal volume of the cylindrical wall at a location that enables the heater to direct heat generated by the heater toward the inner surface of the cylindrical wall, and a transfix roller configured to move into engagement with the outer surface of the cylindrical wall of the image receiving member. The transfix roller includes a second cylindrical wall having an outer surface, a first end, and a second end, and a coating formed on the outer surface of the second cylindrical wall, the coating having a first thickness at a position that is substantially equidistant from the first end and the second end of the second cylindrical wall and a second thickness at the first end and the second end of the second cylindrical wall, the first thickness being greater than the second thickness.

Another embodiment of the ink image receiving and transfer system also enables a printer to commence printing operations from a "cold" state more quickly. The system includes an image receiving member having a cylindrical wall with an outer surface configured to receive and carry phase change ink images and an inner surface defining an internal volume of the image receiving member, and an annular support member positioned in the internal volume of the cylindrical wall, the annular support wall being fixedly engaged to the inner surface of the cylindrical wall, a heater positioned in the internal volume of the cylindrical wall at a location that enables the heater to direct heat generated by the heater toward the inner surface of the cylindrical wall, and a transfix roller configured to move into engagement with the outer surface of the cylindrical wall of the image receiving member. The transfix roller includes a second cylindrical wall having an outer surface, a first end, and a second end, and a coating formed on the outer surface of the second cylindrical wall. The coating has a first thickness at a first location and a second location, and a second thickness at the first end, the second end, and a central circumferential area of the second cylindrical wall, the first location being between the first end of the second cylindrical wall and the central circumferential surface area of the second cylindrical wall, the second location being between the second end of the second cylindrical wall and the central circumferential surface area of the second cylindrical wall. The first thickness is greater than the second thickness of the coating.

DETAILED DESCRIPTION

Figure 1:
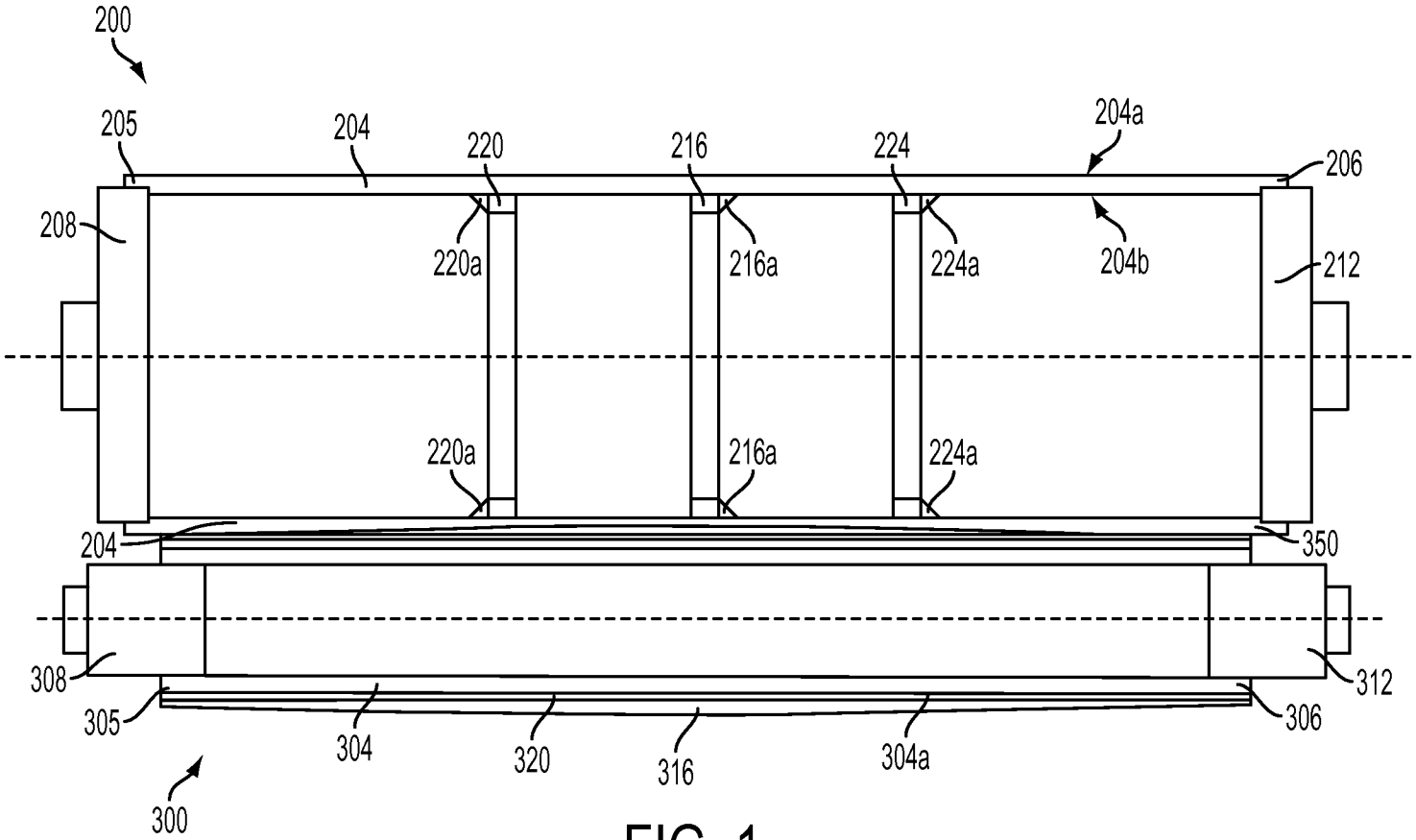
FIG. 1 is a cross sectional view of one configuration of an image receiving member and a transfix roller, with heating elements removed for clarity.

The word "printer" as used herein encompasses any apparatus, such as a digital copier, book making machine, facsimile machine, multi-function machine, and the like, that produces an image with a colorant on recording media for any purpose. Printers that form an image on an image receiving member and then transfer the image to recording media are referenced in this document as indirect printers. Indirect printers typically use intermediate transfer, transfix, or transfuse members to facilitate the transfer of the image from the image receiving member to the recording media. In general, such printing systems typically include a colorant applicator, such as a printhead, that forms an image with colorant on the image receiving member.

An indirect solid ink, or phase-change ink, printer uses inks that are solid at room temperature. The solid ink is heated to a temperature where the ink melts and the liquid ink can then be routed to the printhead and ejected onto an image receiving member. The ink remains at a sufficiently high temperature on the image receiving member that it can be transferred to the recording medium. One type of image receiving member used in an indirect phase-change ink printer is a cylindrical imaging drum. The imaging drum is hollow with the outer surface of the cylindrical wall forming an image receiving surface for ink drops. The imaging drum includes one or more annular support members positioned in contact with an inner surface of the cylindrical wall to distribute a force of pressure that is applied to the imaging drum over the length of the cylindrical wall. The imaging drum is typically formed with a metal cylindrical wall. In one embodiment, the drum is formed from anodized aluminum although other metals and similar materials may be used.

As used herein, the term "annular support member" refers to a support member that is positioned within the imaging drum in engagement with an inner cylindrical wall of the imaging drum that includes an inner radius, an outer radius, and a length that extends longitudinally with the length of the cylindrical wall in the imaging drum. The length may be uniform between the inner and outer radii, or the thickness may be greater at the outer radius than at the inner radius. The length of each annular support member is less than the total length of the cylindrical wall of the imaging drum. The annular support member dimensions are chosen based on the stiffness required to obtain a substantially uniform nip pressure from end to end of the drum-transfix roll nip. If the annular support member is too stiff, then a region of higher nip pressure occurs at the location of the annular support. If the annular support member is not stiff enough, then a region of lower nip pressure occurs at the location of the annular support. Various factors that determine the drum-transfix roll nip pressure distribution include drum and transfix roll length, drum wall thickness and material, transfix roll wall thickness and material, transfix roll crown, and the number of annular support members. For a 161 mm outer diameter aluminum drum that is 345 mm long and 4.5 mm thick, a single annular support member made of steel that is 4 mm long and 12 mm thick provides good nip pressure uniformity. Annular support member lengths can be in the range of 2 mm to 30 mm. The annular support member thickness can range from 2 mm to 20 mm. The various dimensions of the annular support members are selected to provide sufficient support to distribute pressure over the length of the imaging drum while also enabling a heater positioned in the imaging drum to heat the outer surface of the drum to an operating temperature in a shorter time than existing imaging drums. Various configurations of annular support members include hoops, rings, ribs, hollow cylinders, C-shaped rings, and other similarly shaped structures.

Figure 8:
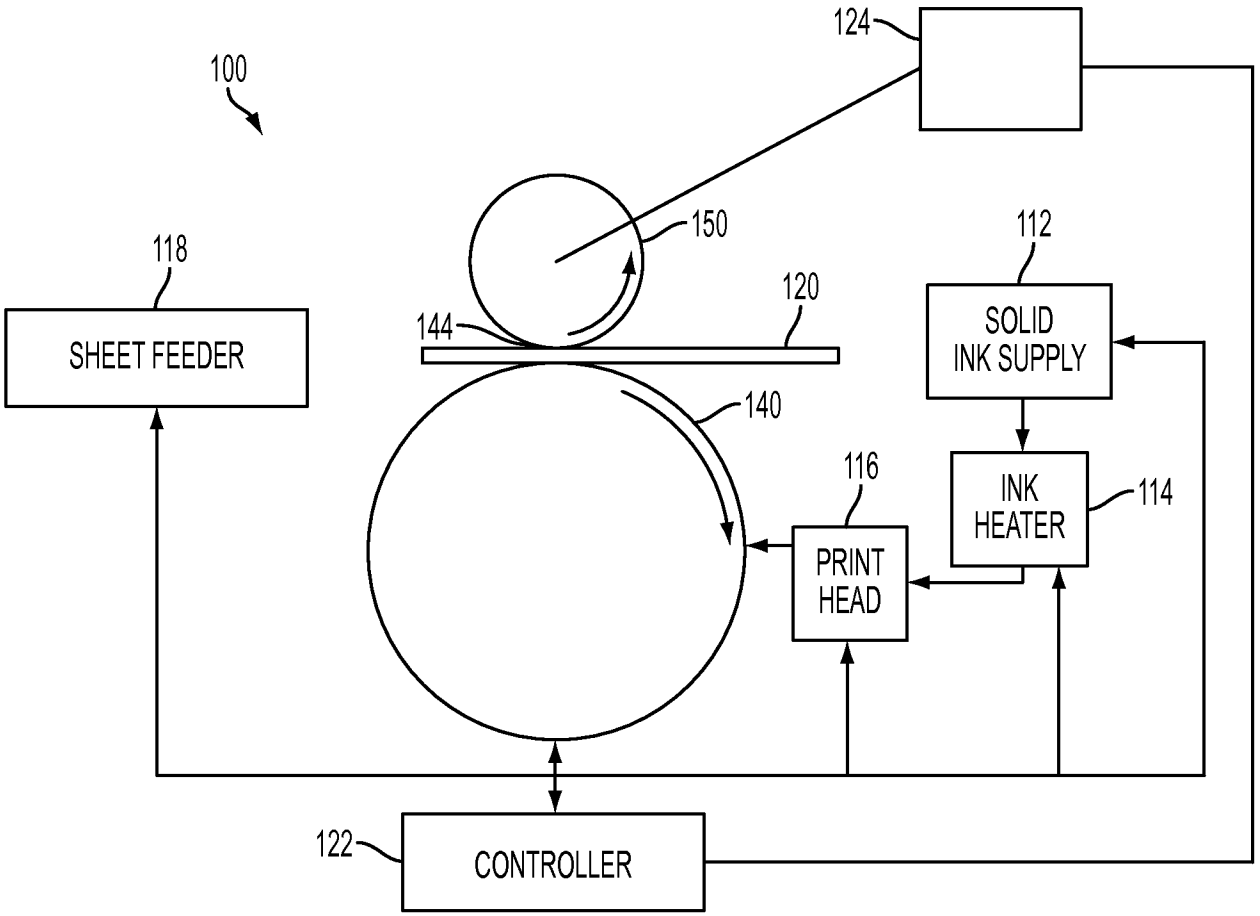
FIG. 8 is a schematic diagram of an indirect printing system with an image receiving member.

FIG. 8 shows an indirect solid ink printer 100. The printer 100 includes an image receiving member 140 (also referred to as a drum, an imaging drum or a print drum) having at least one annular support member and a transfix roller 150. An actuator assembly 124 moves the transfix roller 150 into and out of engagement with the image receiving member 140 to selectively form a nip 144. In one embodiment, the actuator assembly 124 includes lever arms, camshafts, cams, and gears that are driven by an electrical motor that responds to signals from the controller 122 to move the transfix roller 150. In another embodiment, a hydraulic loading system 124 is operated by an electrical motor that responds to signals from the controller 122 to move the transfix roller 150. The printer 100 includes a solid ink supply 112 that is loaded with solid ink sticks. The ink sticks progress through a feed channel of the solid ink supply 112 until they reach an ink melt unit 114. The ink melt unit 114 heats the portion of an ink stick impinging on the ink melt unit 114 to a temperature at which the ink stick melts. The liquefied ink is supplied to one or more printheads 116 by gravity, pump action, or both. Printer controller 122 uses the image data to be reproduced to generate firing signals for the printheads 116 and eject ink onto the image receiving member 140 as image pixels for a printed image. Recording media 120, such as paper or other recording substrates, are fed from a sheet feeder 118 to a position where the image on the image receiving member 140 can be transferred to the media. To facilitate the image transfer process, the media 120 are fed into the nip 144 between the transfix roller 150 and the rotating image receiving member 140. In the nip 144, the transfix roller 150 presses the media 120 against the image receiving member 140 to transfer the ink from the image receiving member 140 to the media 120.

FIG. 1 shows a cross section of an image receiving member 200 and a transfix roller 300 with the heating elements removed for clarity. The image receiving member 200 includes a cylindrical wall 204, a first support member or endbell 208, a second support member or endbell 212, a first annular support member 216, a second annular support member 220, and a third annular support member 224. In one embodiment, the cylindrical wall is formed of aluminum or other suitable material, and includes an outer surface 204*a* and an inner surface 204*b*, a first end 205 and a second end 206. The outer surface 204*a* is configured to receive an image formed of ink from one or more printheads and to transfer the image to a recording medium. The cylindrical wall 204 is supported on the first end 205 by the first endbell 208, and on the second end 206 by the second endbell 212, both of which may be formed of aluminum or other material of sufficient thickness and strength to adequately support the cylindrical wall 204.

Figure 2:
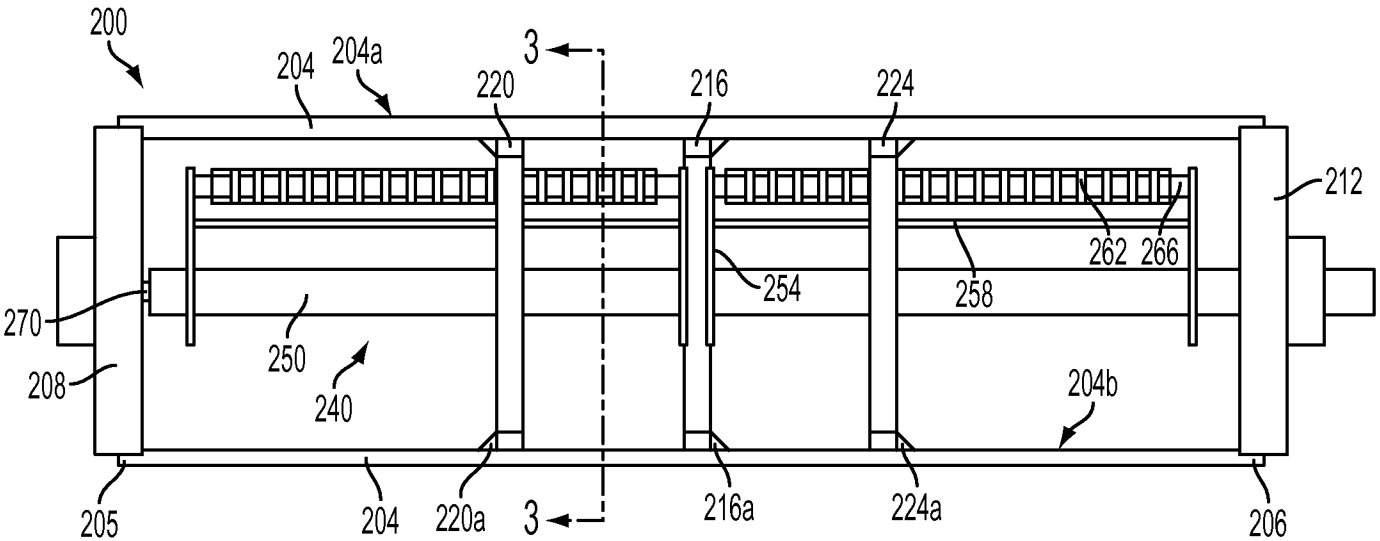
FIG. 2 is a cross sectional view of the image receiving member of FIG. 1 including heating elements.
Figure 3:
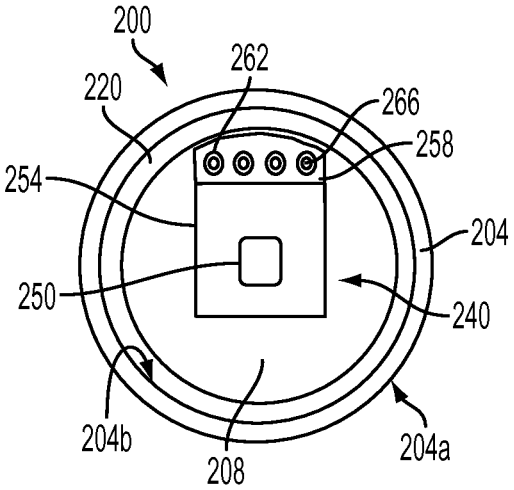
FIG. 3 is a cross sectional view of the image receiving member of FIG. 1 and FIG. 2, taken along line 3-3 of FIG. 2.

In the embodiment of FIG. 1-FIG. 3, the annular support members 216-224 are each formed from a circular hoop with an outer circumference that engages the inner surface 204*b* of the cylindrical wall in the image receiving member 200. The first annular support member 216 is affixed on the inner surface 204*b* of the cylindrical wall 204, substantially centered between the first end 205 and second end 206 of the cylindrical wall 204. Although any suitable attachment techniques may be used, in the embodiment of FIG. 1, the first annular support member 216 is attached to the cylindrical wall 204 by welds 216*a*, which are formed by tack welding. The second annular support member 220 is fixedly attached to the inner surface 204*b* of the cylindrical wall 204 between the first annular support member 216 and the first end 205 by welds 220*a*. The third annular support member 224 is affixed to the cylindrical wall 204 between the first annular support member 216 and the second end 206 by welds 224*a*. The second annular support member 220 and the third annular support member 224 are substantially equidistant from the first annular support member 216. The annular support members 216, 220, and 224 may be formed of any material of sufficient strength to support the cylindrical wall 204, such as aluminum, stainless steel, or the like.

The transfix roller 300 includes a hollow steel cylinder 304, a first endcap 308, a second endcap 312, an inner overcoat layer 320, and an outer overcoat layer 316. The steel cylinder has a first end 305, a second end 306, and an outer surface 304*a*. The first endcap 308 supports the first end 305 of the steel cylinder 304, and the second endcap 312 supports the second end 306 of the steel cylinder 304. The outer surface 304*a* is evenly coated with the inner overcoat layer 320, which is formed of high modulus urethane in one embodiment. The outer overcoat layer 316, which is formed of low modulus urethane in one embodiment, covers the inner overcoat layer 320. In order to equalize the pressure between the transfix roller 300 and the image receiving member 200, the outer overcoat layer 316 is crowned, such that it is thicker in the center than at the first end 305 and second end 306 of the steel cylinder 304. The thickness of the overcoat layer gradually increases from the first end 305 to the center and gradually decreases from the center to the second end 306.

FIG. 2 shows a cross sectional view of the image receiving member 200 including a heater 240, and FIG. 3 shows a cross sectional view of the image receiving member 200 and heater 240 taken along line 3-3 of FIG. 2. The heater 240 includes a mounting shaft 150 having a first end and a second end, two pairs of mica supports 254, two reflectors 258, and eight glass tubes 266, each wrapped with a nichrome coil 262. The mounting shaft 250 extends through the center axis of the cylindrical wall 204, supported on the first end by a bearing 270, which is attached to the first endbell 208, and extending on the second end through the center of the second endbell 212. Two pairs of mica supports 254 connect to the mounting shaft 250, extending toward the inner surface 204*b* of the cylindrical wall 204. The first pair of mica supports 254 is between the first end and the center of the heater mounting shaft 250, while the second pair of mica supports 254 is between the center and the second end of the heater mounting shaft 250. Four glass tubes 266 extend between each pair of mica supports 254. The glass tubes 266 are each wrapped with a nichrome coil 262, which radiates heat toward the inner surface 204*b* of the cylindrical wall 204. A metal reflector 258 is mounted on each pair of mica supports 254 between the nichrome coils 262 and the heater mounting shaft 250 to focus the heat toward a portion of the inner surface 204*a* of the cylindrical wall 204.

When the image receiving member 200 is activated, electric current flows into the nichrome coils, which respond by generating heat. The heat is directed at the inner surface 204*b* of the cylindrical wall 204, and a temperature of the cylindrical wall 204 and the outer surface of the cylindrical wall 204*a* increases in response to the heat. Once the cylindrical wall 204 reaches a specified operating temperature that enables phase change ink ejected onto the outer surface 204*a* to remain in place on the drum for later transfer to a recording medium, a printhead (not shown) ejects ink onto the outer surface 204*a* of the cylindrical wall 204 as the cylindrical wall 204 rotates past the printhead. After the ink image is formed on the drum, a controller operates an actuator to move the transfix roller into contact with the imaging drum so the outer overcoat layer 316 of the transfix roller 300 forms a nip 350 with the outer surface 204*a* of the cylindrical wall 204. A recording medium, such as a sheet of paper, is fed through the nip 350 between the image receiving member 200 and transfix roller 300. The ink transfers from the image receiving member 200 onto the recording medium as it passes through the nip 350.

Figure 4:
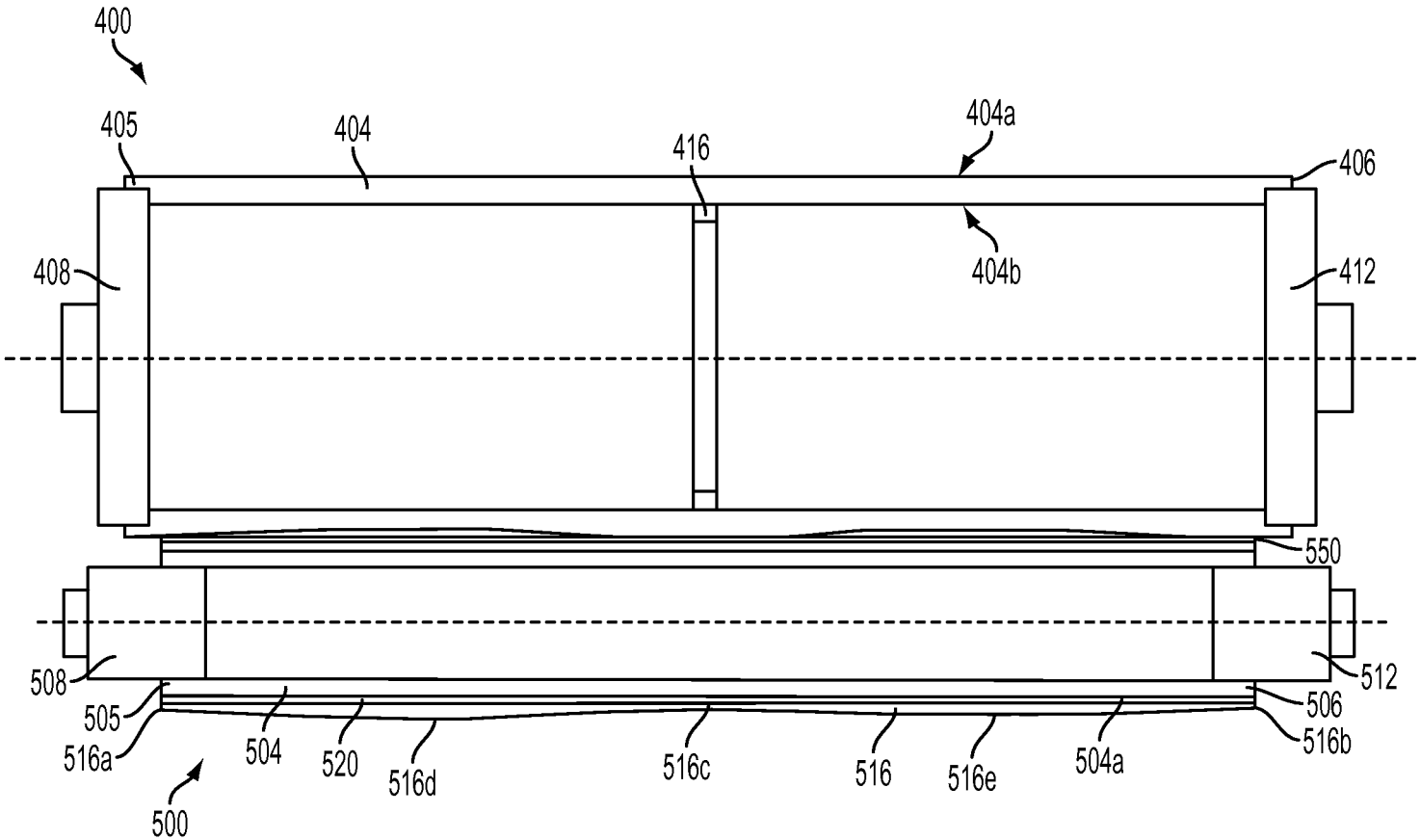
FIG. 4 is a cross sectional view of another configuration of an image receiving member and a transfix roller, with heating elements removed for clarity.

FIG. 4 depicts another configuration of an image receiving member 400 and a transfix roller 500. The image receiving member 400 includes a cylindrical wall 404, a first support member or endbell 408, a second support member or endbell 412, and an annular support member 416. The cylindrical wall 404 has a first end 405, a second end 406, an inner surface 404*a*, and an outer surface 404*b*, and is formed of aluminum or other suitable material. The cylindrical wall 404 is supported on the first end 405 by the first endbell 408, and supported on the second end 406 by the second endbell 412. The annular support member 416 is affixed to the inner surface 404*b* of the cylindrical wall 404, equidistant from the first end 405 and the second end 406.

The transfix roller 500 abuts the image receiving member 400 at a nip 550. The transfix roller 500 includes a hollow steel cylinder 504, a first endcap 508, a second endcap 512, an inner overcoat layer 520, and an outer overcoat layer 516. The steel cylinder 504 has a first end 505, a second end 506, and an outer surface. The steel cylinder 504 is supported on the first end 505 by endcap 508 and on the second end 506 by endcap 512. The outer surface 504*a* is coated evenly with the inner overcoat layer 520, which is composed of high modulus urethane in one embodiment. The outer overcoat layer 516, which is formed of low modulus urethane in one embodiment, covers the outside of the inner overcoat layer 520. The outer overcoat layer 516 has a first end 516*a*, a second end 516*b*, a center 516*c*, and two crowns 516*d* and 516*e*. The outer overcoat layer 516 has a first thickness at the first end 516*a* and the second end 516*b*, and has a second thickness at the center 516*c* where the outer overcoat layer 516 contacts the portion of the cylindrical wall 404 that is supported by the annular support member 416. In the configuration shown, the second thickness is substantially equal to the first thickness, although in other configurations the second thickness may be less than or greater than the first thickness. The outer overcoat layer 516 gradually increases in thickness from each end and the center, forming two crowns 516*d* and 516*e* that are located substantially equidistant from the center of the transfix roller 500. The outer overcoat layer 516 has a third thickness at the crowns 516*d* and 516*e* that is greater than the first thickness and second thickness.

Figure 5:
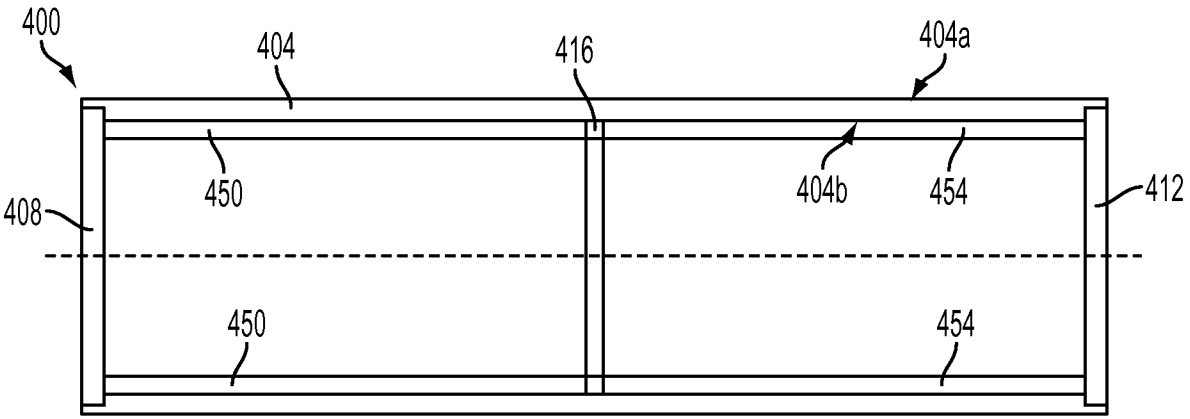
FIG. 5 is a cross sectional view of the image receiving member of FIG. 4, with the heating elements removed for clarity, showing the area machined to produce the annular support member.

FIG. 5 shows the image receiving member 400. The cylindrical wall 404 of the image receiving member 400 is formed by mechanically removing annuli 450 and 454 from the inside of the cylindrical wall 404 through a machining process such as grinding with a lathe. The annular support member 416 remains after the annuli 450 and 454 are removed.

Figure 6:
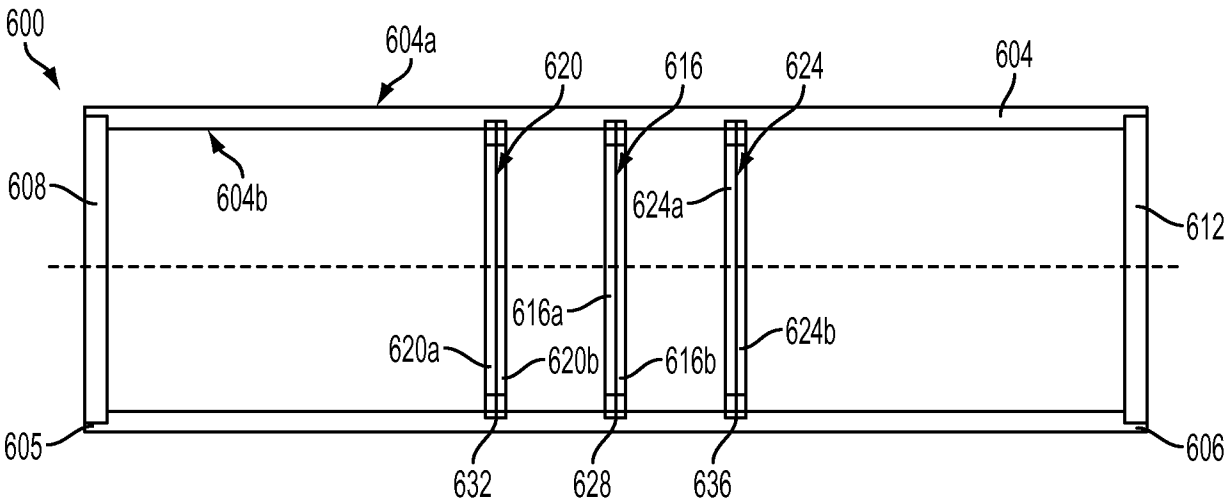
FIG. 6 is a cross sectional view of another configuration of an image receiving member, with heating elements removed for clarity.

FIG. 6 illustrates another configuration of an image receiving member 600. The image receiving member 600 includes a cylindrical wall 604, a first support member or endbell 608, a second support member or endbell 612, first, second, and third annular support members 616, 620, and 624, and first, second, and third grooves 628, 632, and 636. The cylindrical wall 604 has a first end 605, a second end 606, an outer surface 604*a*, and an inner surface 604*b*. The cylindrical wall 604 is supported on the first end 605 by the first endbell 608, and on the second end 606 by the second endbell 612. The inner surface 604*b* of the cylindrical wall 604 contains the first circular groove 628, which is substantially centered between the first 608 and second 612 endbells. The second 632 and third 636 circular grooves are positioned substantially equidistant from the first circular groove 628, in the direction of the first end 605 and second end 606 respectively.

Figure 7:
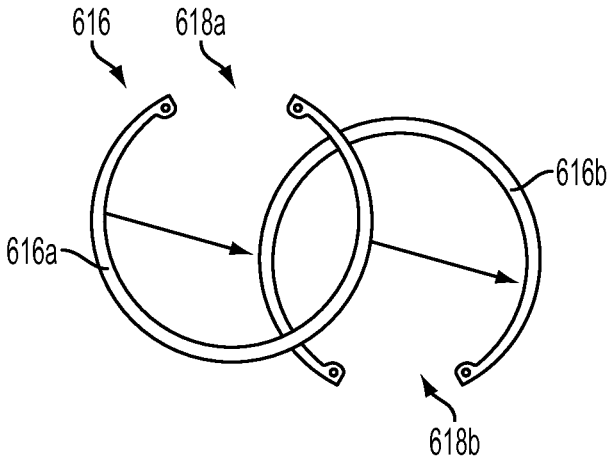
FIG. 7 is a view of the C-shaped rings of the configuration of FIG. 6.

The first circular groove 628 contains the first annular support member 616. In the embodiment of FIG. 6, the first annular support member 616 includes two opposite-facing C-shaped rings 616*a* and 616*b*, as shown in FIG. 7. C-shaped ring 616*a* includes an opening 618*a* that is arranged opposite a corresponding opening 618*b* formed in the ring 616*b*. The C-shaped rings 616*a* and 616B are positioned in the first circular groove 628. Each of the C-shaped rings 616 compresses when inserted into the inner volume of the image receiving member 600, and the C-shaped rings expand to conform to the groove 628. After being inserted into the groove 628, the C-shaped rings 616*a* and 616*b* are fastened together by, for example, rivets, bolts or welds to form a single circular member fixed to the groove 628. The second annular support member 620 includes two C-shaped rings 620*a* and 620*b* fitted in the second circular groove 632 and fastened together in the same manner as annular support member 616. The third annular support member 624 includes two C-shaped rings 624*a* and 624*b* fitted in the third circular groove 636 and fastened together in the same manner as the annular support members 616 and 620.

The presence of annular support members allows the cylindrical wall of the image receiving member to be thinner than the cylindrical wall of image receiving members of previously known indirect printers, while maintaining the structural integrity of the image receiving member. In the embodiments described above, cylindrical walls 204, 404, and 604 have thickness of about 5 millimeters, compared to approximately 9 millimeters for the cylindrical walls used in previously known indirect printers. The thicker wall was required to provide appropriate pressure in the nip formed with the transfix roller without suffering deformation of the image receiving member during the operational life of the printer. The thinner cylindrical wall of the embodiments described above have less mass. Therefore, these image receiving members are able to respond to the heat generated by the heaters in the members more quickly than the thicker image receiving members used in previously known heaters. The annular support members enable the thinner walls of these image receiving members to produce sufficient pressure in the transfer nip without suffering deformation. The crowned outer overcoat layer also helps equalize the pressure distribution between the image receiving member and the transfix roller along the width of the nip. A substantially even pressure distribution is desirable to ensure that the image quality of the printed media is not degraded by unequal pressure between the image receiving member and transfix roller when the ink is transferred from the image receiving member to the recording medium. As the image receiving member wall thickness is reduced, the wall experiences increased deformation under pressure from the transfix roll. For image receiving members with thinner walls, a greater number of annular support members and/or thicker or longer annular support members result in smaller image receiving member deformations when the image receiving member engages the transfix roller. Consistent with adequately uniform nip pressure, the number of annular support members should be minimized to minimize the cost of the image receiving member assembly.

It will be appreciated that variants of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

We claim:

1. An image receiving member for use in a phase-change inkjet printer comprising:

a cylindrical wall having a first and a second end having a length between the first end and the second end and a thickness that form an outer surface configured to receive and carry phase change ink images and an inner surface defining an internal volume of the image receiving member;

a first annular support member positioned in the internal volume of the image receiving member that is fixedly engaged to at least a portion of the inner surface of the cylindrical wall, the first annular support member having a length that is less than the length of the cylindrical wall, the first annular support member comprising a first C-shaped compressible ring and a second C-shaped compressible ring inserted in a groove formed in the inner surface of the cylindrical wall and fastened together after insertion in the groove, an opening of the first compressible C-shaped ring being positioned on and adjacent to a side of the internal volume that is diametrically opposite from a side of the internal volume that an opening of the second compressible C-shaped ring is adjacent;

a second annular support member positioned between the first annular support member and the first end of the cylindrical wall, the second annular support member being fixedly engaged to the inner surface of the cylindrical wall;

a third annular support member positioned between the first annular support member and the second end of the cylindrical wall, the third annular support member being fixedly engaged to the inner surface of the cylindrical wall; and a heater positioned in the internal volume of the cylindrical wall at a location that enables the heater to direct heat generated by the heater toward the inner surface of the cylindrical wall.

2. The image receiving member of claim 1, the first annular support member being positioned substantially equidistant between the first end of the cylindrical wall and the second end of the cylindrical wall.

3. The image receiving member of claim 1 further comprising:

a first support member positioned at the first end of the cylindrical wall; and a second support member positioned at the second end of the cylindrical wall.

4. An ink image receiving and transfer apparatus comprising:

an ink receiving member having a cylindrical wall having an outer surface configured to receive and carry phase change ink images and an inner surface defining an internal volume of the image receiving member, the cylindrical wall having a first end and a second end;

a plurality of annular support members positioned in the internal volume of the cylindrical wall, each annular support member being positioned between the first end and the second end of the cylindrical wall and being fixedly engaged to the inner surface of the cylindrical wall, at least one annular support member in the plurality of annular support members further comprising a first C-shaped compressible ring and a second C-shaped compressible ring inserted in a groove formed in the inner surface of the cylindrical wall and fastened together after insertion in the groove, an opening of the first compressible C-shaped ring being positioned on and adjacent to a side of the internal volume that is diametrically opposite from a side of the internal volume that an opening of the second compressible C-shaped ring is adjacent;

a heater positioned in the internal volume of the cylindrical wall at a location that enables the heater to direct heat generated by the heater toward the inner surface of the cylindrical wall; and a transfix roller configured to move into engagement with the outer surface of the cylindrical wall of the image receiving member, the transfix roller comprising:

a second cylindrical wall having an outer surface, a first end, and a second end; and a coating formed on the outer surface of the second cylindrical wall, the coating having a first thickness at a position that is substantially equidistant from the first end and the second end of the second cylindrical wall and a second thickness at the first end and the second end of the second cylindrical wall, the first thickness being greater than the second thickness.

5. The ink image receiving and transfer apparatus of claim 4 wherein each annular support member in the plurality of annular support members is positioned from a next annular support member in the plurality of annular support members at a predetermined distance.

6. The ink image receiving and transfer apparatus of claim 4 further comprising:

a first support member positioned at the first end of the cylindrical wall; and a second support member positioned at the second end of the cylindrical wall.

7. The ink image receiving and transfer apparatus of claim 4, the coating of the transfix roller being substantially composed of polyurethane.

8. An ink image receiving and transfer apparatus comprising:

an image receiving member having a cylindrical wall with an outer surface configured to receive and carry phase change ink images and an inner surface defining an internal volume of the image receiving member; and an annular support member positioned in the internal volume of the cylindrical wall, the annular support wall being fixedly engaged to the inner surface of the cylindrical wall, the annular support member further comprising a first C-shaped compressible ring and a second C-shaped compressible ring inserted in a groove formed in the inner surface of the cylindrical wall and fastened together after insertion in the groove, an opening of the first compressible C-shaped ring being positioned on and adjacent to a side of the internal volume that is diametrically opposite from a side of the internal volume that an opening of the second compressible C-shaped ring is adjacent;

a heater positioned in the internal volume of the cylindrical wall at a location that enables the heater to direct heat generated by the heater toward the inner surface of the cylindrical wall; and a transfix roller configured to move into engagement with the outer surface of the cylindrical wall of the image receiving member, the transfix roller comprising:

a second cylindrical wall having an outer surface, a first end, and a second end; and a coating formed on the outer surface of the second cylindrical wall, the coating having a first thickness at a first location and a second location, and a second thickness at the first end, the second end, and a central circumferential area of the second cylindrical wall, the first location being between the first end of the second cylindrical wall and the central circumferential surface area of the second cylindrical wall, the second location being between the second end of the second cylindrical wall and the central circumferential surface area of the second cylindrical wall, the first thickness being greater than the second thickness of the coating.

9. The ink image receiving and transfer apparatus of claim 8 further comprising:

a first support member positioned at a first end of the cylindrical wall; and a second support member positioned at a second end of the cylindrical wall.

10. The ink image receiving and transfer apparatus of claim 8, the annular support member being positioned substantially equidistant between a first end of the cylindrical wall and the second end of the cylindrical wall.

11. The ink image receiving and transfer apparatus of claim 8, the coating being substantially composed of polyurethane.

* * * * *